US005519891A

United States Patent [19]

Peters et al.

[11] Patent Number: 5,519,891

[45] **Date of Patent: *May 28, 1996**

[54] PROTECTIVE SHEATH FOR CAP STRAP

[76] Inventors: Alexander C. Peters, 560 W. 43rd St., #36B, New York, N.Y. 10036; Robert E. Peters, 1326 Miller Dr., Los Angeles, Calif. 90069

[ * ] Notice: The term of this patent shall not extend beyond the expiration date of Pat. No. 5,315,714.

[21] Appl. No.: 238,917

[22] Filed: May 6, 1994

Related U.S. Application Data

[63] Continuation of Ser. No. 954,746, Sep. 30, 1992, Pat. No. 5,315,714.

[51] Int. Cl.[6] ..... A42B 1/24

[52] U.S. Cl. ..... 2/181.4; 2/181; 2/195.2; 2/209.13; 40/329

[58] Field of Search ..... 2/181.4, 209.13, 2/181, 181.2, 183, 195.1, 195.2, 195.3, 195.4; 40/329

[56] References Cited

U.S. PATENT DOCUMENTS

| | | | |
|---|---|---|---|
| Re. 33,430 | 11/1990 | Nunnery et al. | 2/181 |
| 3,894,731 | 7/1975 | Evans | 269/47 |
| 4,856,116 | 8/1989 | Sullivan | 2/181 |
| 4,905,879 | 3/1990 | Piccone | 224/173 |
| 4,918,758 | 4/1990 | Rendina | 2/171 |
| 5,003,640 | 4/1991 | Pizzacar | 2/199 |
| 5,058,211 | 10/1991 | Hanks | 2/206 |
| 5,153,943 | 10/1992 | Clement | 2/199 |
| 5,161,259 | 11/1992 | Shorts | 2/199 |
| 5,282,278 | 2/1994 | Miner | 2/181.4 |
| 5,287,559 | 2/1994 | Christiansen et al. | 2/209.13 |
| 5,315,714 | 5/1994 | Peters et al. | 2/209.13 |

OTHER PUBLICATIONS

Copy of photographs of a Krazy Kapperz product.

Copy of File Wrapper of Trademark Application Serial No. 74/407900, filed Jul. 1, 1993 pp. 1–15.

*Primary Examiner*—Diana Biefeld

*Attorney, Agent, or Firm*—Weingarten, Schurgin, Gagnebin & Hayes

[57] ABSTRACT

A method and apparatus for covering and protecting engagement regions of interconnecting straps employed with apparel. In one embodiment, the apparatus includes a sheath of material which is generally tubular in shape having a inner wall and an outer wall, wherein the inner wall of the tube defines a cavity therein. The sheath is sized to permit disposition of the sheath over at least a portion of interconnecting straps employed in conjunction with certain apparel. The sheath has a predetermined length which is selected to permit the sheath to cover at least a portion of engagement regions of the respective interconnecting straps when disposed thereon.

6 Claims, 4 Drawing Sheets

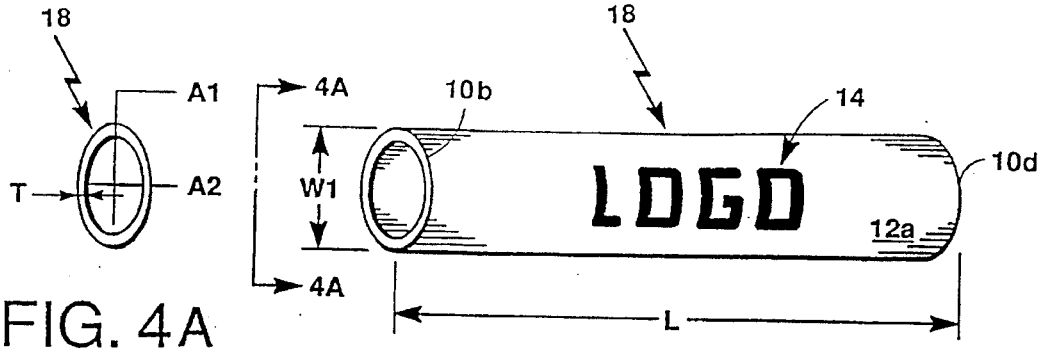
FIG. 4A
FIG. 4
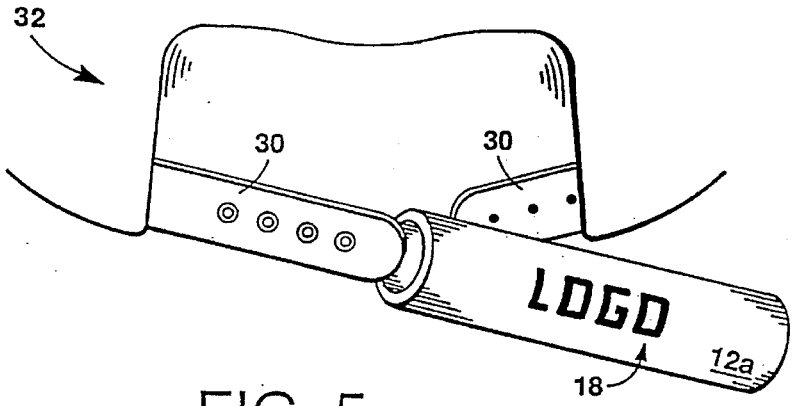
FIG. 5
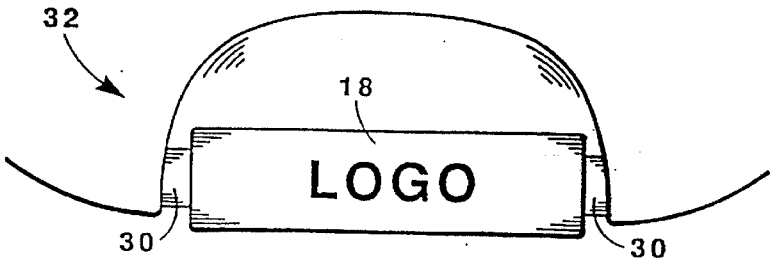
FIG. 5A

PROTECTIVE SHEATH FOR CAP STRAP

RELATED APPLICATION

The application is a continuation of application Ser. No. 07/954,746, filed Sep. 30, 1992, entitled: A PROTECTIVE SHEATH, now U.S. Pat. No. 5,315,714.

BACKGROUND OF THE INVENTION

This invention relates to protective covers or sheaths and more particularly to protective sheaths for interconnecting straps employed on apparel.

As is known in the art, clothing and other apparel often include straps used to fasten one portion of the apparel to another portion or to an external item. For example, wrist watch straps fasten a wristwatch to the wrist of a wearer, a belt disposed around a wearer's waist has first and second ends coupled to each other. Similarly, straps provided on a baseball cap afford variability in hat size to accommodate a specific individual. The interconnection straps employed with baseball caps, for example, are typically made of plastic and have cooperating bosses on the engagement portions thereof to permit the respective straps to be disengageably fastened to one another for the purpose of sizing the cap to accommodate a specific wearer. Such straps and the engagement regions thereof, can contact the user and may cause abrasion and discomfort. Additionally such straps may become inadvertently detached due to the fact the engagement portions of the respective straps are exposed permitting one of the straps to be caught so as to pull the cooperative engagement regions of the respective straps apart. Furthermore, such straps also fail to provide an aesthetically pleasing appearance.

SUMMARY OF THE INVENTION

In accordance with the present invention a protective sheath is disclosed. The sheath is generally tubular, has a predetermined length and is preferably fabricated from a soft compressive and deformable material. The tubular sheath has an inner surface which defines a cavity with the sheath. The sheath is dimensioned to allow the sheath to be disposed over at least the engagement portions of the interconnecting straps and thereby cover at least the portion of the straps which is most likely to be abrasive and to cause discomfort to a user. The thickness of the sheath is selected to provide desired comfort to a user. The length of the sheath is selected such that when the sheath is disposed over the interconnecting straps, the sheath covers at least a portion of an interconnecting region between the interconnecting straps. Preferably, the sheath covers the majority of the interconnecting straps which would otherwise be visible. By disposing the sheath over the interconnecting straps, the sheath provides an aesthetically pleasing cover which is softer, more comfortable than the strap about which the sheath is disposed. Moreover, by disposing the sheath over the engagement portions of the respective interconnection straps the sheath assists in avoiding the inadvertent disengagement of the interconnecting straps.

The sheath may be molded or formed into a predetermined generally tubular shape using typical injection molding techniques, extrusion techniques or any other manufacturing techniques known in the art.

In accordance with a further aspect of the present invention, a method of forming the sheath is disclosed which includes the steps of folding and fastening together opposing edges of a sheet of material to provide a tubular shaped sheath defining a cavity having a predetermined length and interior dimensions and having a first internal surface and a second external surface. The method further includes the step of inverting the tubular shaped sheath such that the first internal surface of the sheath becomes an external surface of the sheath and the second external surface becomes an internal surface of the sheath. With this particular method, a tubular shaped sheath of predetermined dimensions is produced which may be slidably disposed over at least the engagement regions of an interconnecting strap. An emblem, a plurality of alpha-numeric characters or any desirable indicia may be provided on the surface of the sheet of material which is visible when disposed over the interconnecting straps. The sheet of material used to produce the sheath may be cut or otherwise provided from a larger sheet of material having a plurality of emblems or indicia provided on a surface intended to be the visible surface of the sheath. Alternatively, the indicia may be applied to the material after cutting of the larger sheet into pieces employed to make the individual sheaths.

BRIEF DESCRIPTION OF THE DRAWINGS

The invention will be more fully understood from the following detailed description in conjunction with the drawings, of which:

FIGS. 4 and 4A are sheaths having letter characters disposed on a first surface thereon;

FIGS. 5 and 5A are interconnecting straps having a sheath disposed thereon;

DESCRIPTION OF THE PREFERRED EMBODIMENTS

Figure 1:
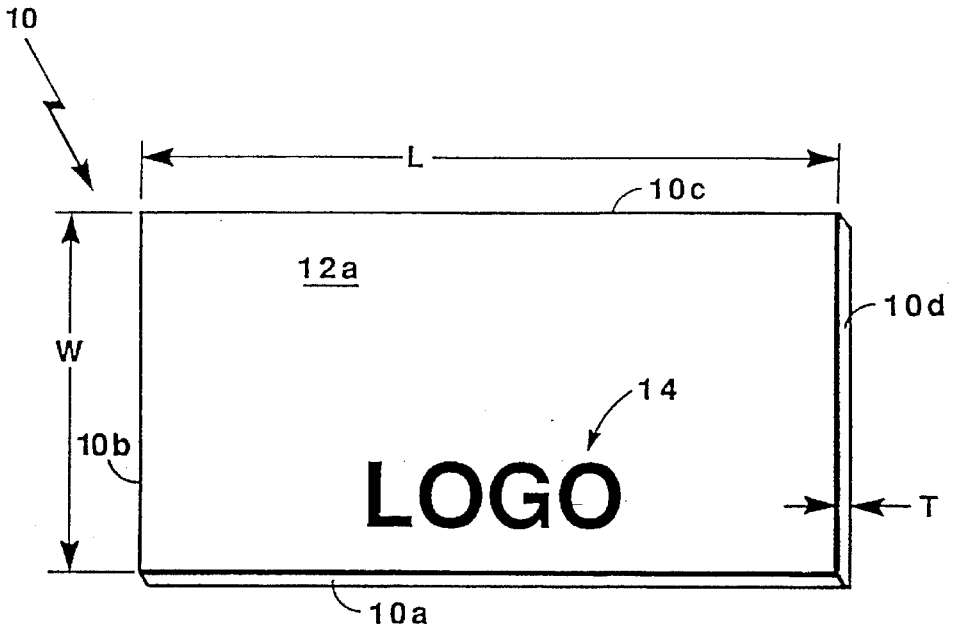
FIGS. 1 and 1A is a sheet of material from which a sheath may be fabricated.
Figure 1A:
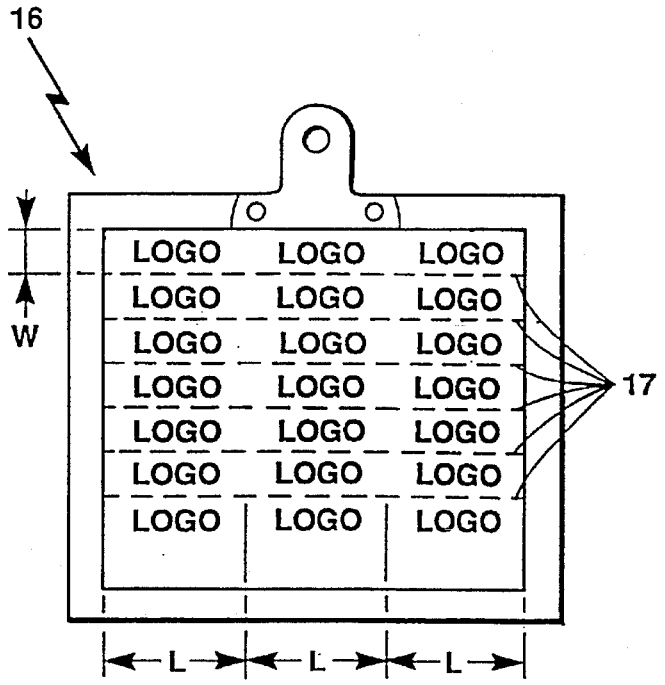

Referring to FIG. 1, a single sheet of material 10, is provided having a length L, a width W and a thickness T. It should be noted that the single sheet 10 may be die cut or otherwise provided from a larger sheet 16 (FIG. 1A) of like material as will be described in conjunction with FIGS. 6 and 6A below. The sheet 10 may be provided from a synthetic rubber such as neoprene or any other flexible, compressible and deformable material having like characteristics. Those of skill in the art will recognize of course that other materials such as woven fabrics, flexible plastics, foams, rubbers, or like materials may also be used as well as combinations and/or laminates of such materials. The selection of a particular material or materials may be made according to a variety of factors including but not limited to cost and ease of manufacture, compressibility, wearing comfort, absorption characteristics and strength.

Sheet 10 has four smooth edges 10*a*–10*d*, however, sheet 10 may also be provided having patterned edges. For example, one or all of the edges 10*a*–10*d* of the sheet 10 may be scalloped, V-shaped or provided in other shapes.

An emblem or a plurality of alpha-numeric characters 14 may optionally be provided on a first surface 12*a* of the sheet 10 using silk screening techniques. Other techniques such as embroidering may also be used to provide the characters 14 on the surface 12*a*. The particular technique used to provide the characters 14 on the sheet 10 may be selected according to a variety of factors including but not limited to the type of material from which the sheet 10 is made, the aesthetic appearance of the characters 14 on the sheet, the ease with which the characters 14 may be disposed on the sheet 10, and cost.

Figure 2:
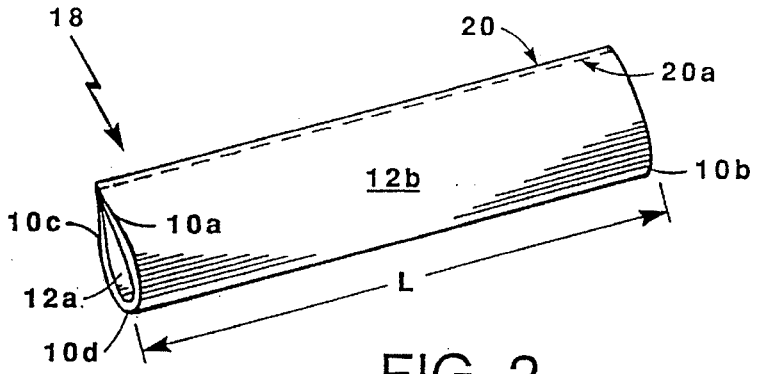
FIG. 2 is a sheath formed from the sheet of FIG. 1.

Referring now to FIG. 2 in which like elements of the sheet 10 are provided having like designations, the sheet 10 is folded such that opposing edges 10*a*, 10*c* of the first surface 12*a* are placed in contact to provide a tube-like sheath 18. Thus, the first surface 12*a* having the characters 14 provided thereon corresponds to an inner surface of the sheath 18 and a second surface 12*b* here corresponds to an outer surface of the sheath 18.

The like edges 10*a*, 10*c* of the sheath 18 may then be fixed to each other using any technique well known to those of ordinary skill in the art. In the present embodiment, the like edges are stitched together as generally denoted at 20 to provide a seam 20*a*. Alternatively, the edges 10*a*, 10*c* may be glued or fixed to each other using fasteners such as staples, rivets, Velcro™ or any other fastener and/or suitable fastening technique with which such edges may be inexpensively and quickly fixed to each other. The particular technique used to fix the edges 10*a*, 10*c* of the sheath 18 together may be selected according to a variety of factors including but not limited to the characteristics of the material from which the sheath 18 is made, the final aesthetic appearance of the fastener, the aesthetic appearance of the sheath 18, and the ease of manufacture and cost of the sheath 18.

Figure 3:
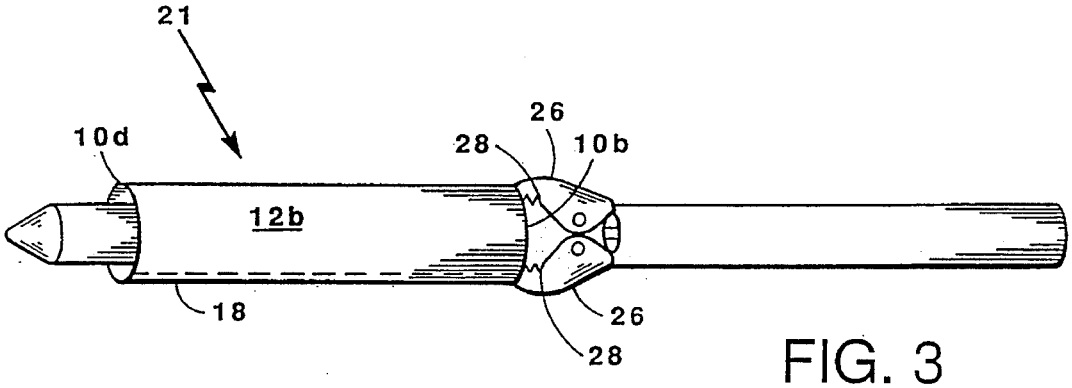
FIGS. 3 and 3A are diagrammatical views of an exemplary inverting device for inverting the sheath.
Figure 3A:
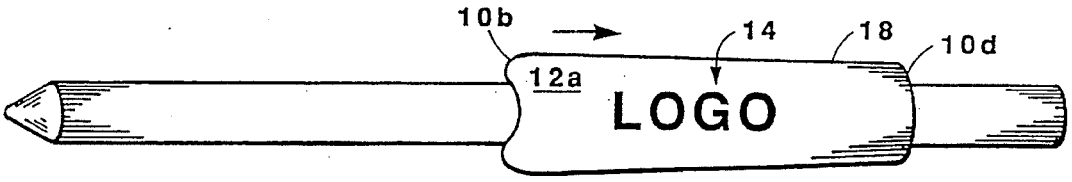

Referring now to FIGS. 3 and 3A, an inverting device 21 includes a member 22 and a clamp 24 operatively coupled to the member 22. To facilitate the inversion of the sheath 18, the sheath 18 is disposed about the member 22. The clamp 24 includes a pair of jaws 26 having a pair of holding edges 28 here the edges are provided having serrations therein. To invert the sheath 18, the edges 28 of the clamp 24 engage a first end of the sheath 10*b* and hold the first end 10*b* of the sheath 18 against the member 22. The second end 10*d* of the sheath 18 is then drawn over and past the clamp 24. The jaws 26 of the clamp 24 are subsequently opened to release the first end 10*b* of the sheath 18 and the sheath 18 may be removed from the member 22. Thus, the inner and outer surfaces of the sheath 18 are reversed by drawing one edge 10*d* of the sheath 18 over the edge 10*b* of the sheath.

Consequently, in those sheets 10 having the characters 14 provided on the surface 12*a* thereof, the characters 14 are now viewable on the exposed outer surface 12*a* of the sheath 18. Furthermore, if the two edges 10*a*, 10*c* have been fixed by a stitching process, the joined edges 10*a*, 10*c* are now on the inner surface of the tubular sheath 18 and the finished seam 16*a* is viewable on the outer surface of the sheath 18. Thus, after the inner and outer surfaces of the sheath 18 have been reversed to expose the surface 12*a* and the characters 14, the tubular shaped sheath 18 may be disposed on interconnecting straps as will be described in conjunction with FIG. 5 below.

Figure 3B:
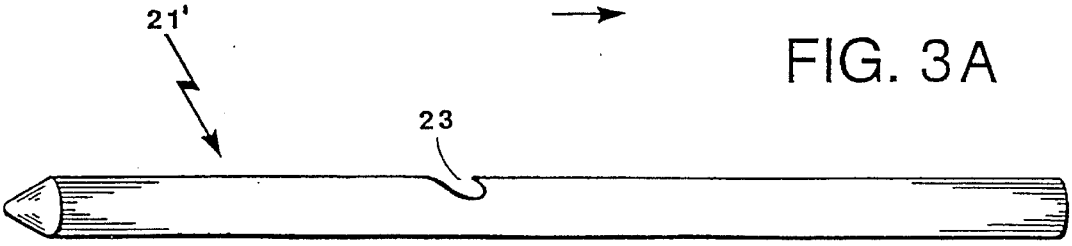
FIG. 3B is a diagrammatical view of an alternate embodiment of a device for inverting the sheath.

FIG. 3B illustrates an alternate embodiment of an inverting device 21' which includes a member 22' having a hooked notch 23 therein. The member 22' may be provided having any cross sectional shape and diameter selected such that the sheath 18 (FIG. 3) may be disposed over the member 22'. In operation, the member 22' is disposed through the center of the tubular sheath 18 and the hooked notch 23 catches a first end of the sheath 10*b* (FIG. 3) as the member 22' passes through the center of the sheath 18. The hooked notch catches and holds the end 10*b* of the sheath 18 and draws the end 10*b* past the second end 10*d* (FIG. 3) of the sheath 18 to thus invert the sheath 18. Alternatively, the second end 10*d* may be drawn over and past the hooked notch 23 to thus invert the sheath 18.

Referring now to FIGS. 4 and 4A the sheath 18 has been inverted to expose the surface 12*a* and the characters disposed thereon. The tubular sheath 18 is shown to have a length L, a width W1, a thickness T, and a central opening therethrough. It should be noted that the sheath 18 is here provided having a substantially oval cross-sectional shape having a major axis length A1 and a minor axis length A2. However, the sheath 18 may of course be provided having substantially circular, square or any other cross-sectional shape which may be selected in accordance with the size and shape of the interconnecting strap over which the sheath 18 may be disposed and of course based upon the flexibility and nature of the selected sheath material.

Furthermore, in addition to the steps for forming the sheath 18 described above in conjunction with FIGS. 1–3A, the sheath 18 may also be formed in a predetermine tubular shape using injection molding techniques, extrusion techniques or any other manufacturing techniques suitable for providing the sheath 18.

Referring now to FIGS. 5 and 5A, the tubular shaped sheath 18 is disposed over a pair of interconnecting straps 30*a*, 30*b* generally denoted 30. Here the straps 30 are shown attached to a hat such as a baseball cap 32 having a normally frontal portion (not shown), a posterior portion 32*a*, a top (not shown) and a bottom portion 32*b*. The posterior portion of the cap 32*a* has a generally inverted U shaped opening 33 extending toward the bottom of the cap 32*b*. The interconnecting strap 30*a* is attached to the cap 32 adjacent to the opening 33 at the cap bottom 32*b* and extends generally across the opening 33. The strap has a first engagement region 31 here provided as a plurality of holes 31*a*–31*e* through the strap 31*a*. The strap 30*b* acts as an engagement member which is attached to the cap 32 adjacent the opening 33 at the bottom of the cap 32*b*. The strap 30*b* has an engagement region 35 here provided as a plurality of raised discs 35*a*–35*d* which securely fit into the holes 31 and are thus cooperative with the engagement region 31. It should be noted that either of the straps 30*a*, 30*b* may be omitted and an engagement member such as a clip or other engagement member (not shown) may be attached to the cap for disengageably coupling the interconnecting strap.

To apply the sheath 18 and thus provide a protective cover over at least one interconnecting straps, the sheath 18 is disposed over a first one, here strap 30*a*, of the interconnecting straps 30*a*, 30*b*. The sheath 18 is deformed to expose the engagement region 31 and the engagement region 31 of the first interconnecting strap 30*a* is engaged to the engagement region 35 the second strap 30*b*. The sheath 18 may then be adjusted about at least a portion of the engagement regions 31, 35 to cover the portion of the engagement regions and to display the indicia in a desired manner.

It should be noted that a suitably sized sheath 18 may also be disposed over interconnecting straps on any type of apparel. For example, the sheath 18 may be disposed over interconnecting straps of a wristwatch, a hospital patient identification wrist strap, a belt or any other item having interconnecting straps connected thereto. Furthermore, if the two edges of the sheath are connected by Velcro™, the sheath 18 may be disposed over a continuous strap.

It will be appreciated by those of ordinary skill in the art that the sheath 18 may be provided from a material which may be stretched to provide a sheath 18 which may be adapted to fit over straps having a variety of dimensions. Furthermore, the material from which the sheath 18 is fabricated may be selected such that the sheath 18 may protect a wearer (not shown) from abrasive straps and thus provide the wearer with a more comfortable fit. For example, in the case where the sheath 18 is disposed over the interconnecting strap 30 of the baseball cap 32, the sheath 18 may protect the wearer's forehead from the abrasive straps 30 when the baseball cap is worn backwards as is commonly done by catchers in the game of baseball as well as others. Moreover the material from which the sheath is fabricated may be selected having a predetermined absorption characteristic of such that the sheath 18 is able to absorb perspiration on the head of a user for example.

Figure 6:
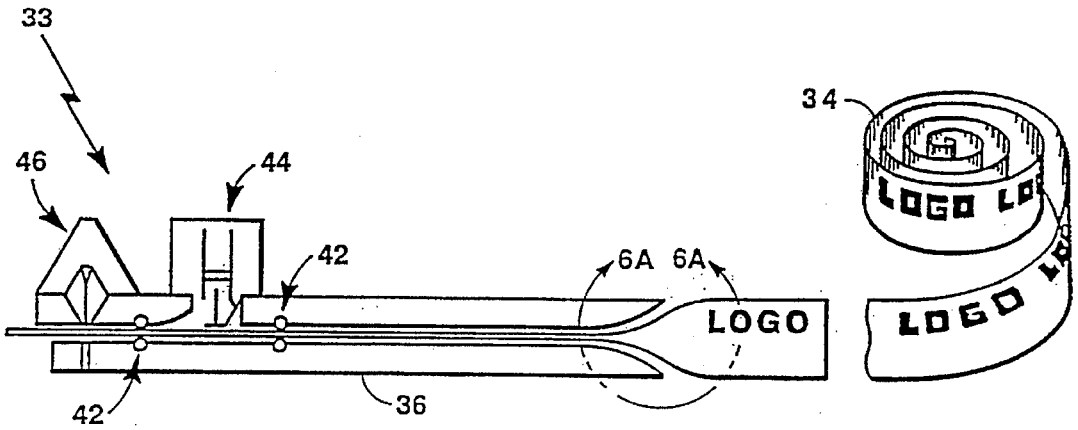
FIG. 6 is a diagrammatic view of an exemplary apparatus for fabricating a sheath.
Figure 6A:
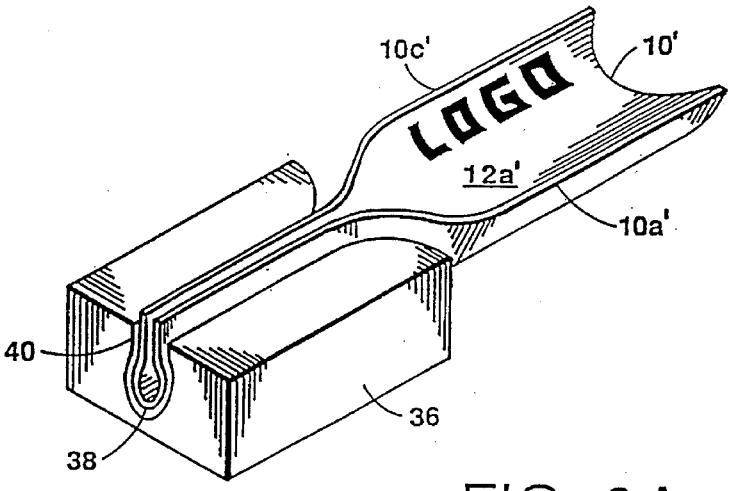
FIG. 6A is a portion of a folding frame used in the fabricating apparatus of FIG. 6.

Referring now to FIGS. 6 and 6A, an exemplary apparatus 33 for providing a plurality of sheaths 18 (FIG. 4) from a rolled sheet 34 includes a folding frame 36 having a groove 38 therethrough and a slot 40 between a first surface 36*a* of the frame 36 and the groove 38. The rolled sheet 34 may be provided for example by cutting the sheet 16 (FIG. 1A) along lines 17 to provide strips of material (not shown).

The rolled sheet 34 is fed into the groove 38 and the folding frame 36 folds the portions 10' of the sheet 24 fed thereto such that the edges 10*a*' and 10*c*' are paced in contact with each other along the surface 12*a*'. The pair of edges 10*a*', 10*c*' of the sheet 10' are exposed through the slot 40 in the folding frame 36. A pair of rollers 42 draw the rolled sheet 34 into the folding frame 36 and through a stitching apparatus 44 which, in a predetermined region of the sheet, stitches the exposed edges 10*a*', 10*c*' of the folded sheet 10' together.

The folded sheet 10' with the edges 10*a*', 10*c*' fixed together are then fed to a cutting apparatus 46 which cuts the sheet 10' at predetermined lengths to provide a plurality of sheaths 18 (FIG. 2) which may be then inverted as described above in conjunction with FIGS. 3 and 3A. As mentioned above, the cutting apparatus 46 may provide the sheaths 18 (FIG. 2) having patterned edges.

Having described preferred embodiments of the invention, it will be apparent to those of ordinary skill in the art that other embodiments incorporating their concepts may be used. It is felt, therefore, that these embodiments should not be limited to disclosed embodiments but rather should be limited only by the spirit and scope of the appended claims.

What is claimed is:

1. A piece of headwear comprising:

a cap having a normally frontal portion and a posterior portion, a top and a bottom and wherein said posterior portion is provided having a generally inverted U shaped opening extending toward said bottom of said cap;

a first interconnecting strap attached to said cap adjacent to the said opening at the bottom of said cap and extending generally across said opening, said first interconnecting strap having a first engagement region;

an engagement member having an engagement region, said engagement member attached to said cap adjacent the opening at the bottom of said cap and opposite said first interconnecting strap, said first interconnecting strap coupled to said engagement member at the engagement region of said engagement member;

a sheet of compressive, deformable material having a predetermined width extending from a first edge to a second edge and having a predetermined length extending from a first end to a second end wherein the first end of said sheet is mated to the second end of said sheet at a seam to form a single seamed tube having an inner surface and an outer surface, said inner surface defining a cavity having dimensions selected to permit said tube to be disposed over at least a portion of the first engagement region of said first interconnecting strap wherein said tube is disposed over at least a portion of said first interconnecting strap; and wherein the single seam of said tube is non-disengageable;

said sheet does not include any predetermined hinged area; and when the first end of said sheet is mated to the second end of said sheet at the seam to form the single seamed tube, said single seamed tube is provided having a substantially circular cross-sectional diameter.

2. The piece of headwear as recited in claim 1 wherein the seam of said tube is provided as a substantially continuous seam formed as a sewn seam which extends substantially along the entire length of said tube.

3. The piece of headwear as recited in claim 2 wherein said compressive, deformable material is neoprene.

4. The piece of headwear as recited in claim 3 wherein the inner surface of said tube is continuous.

5. A piece of headwear comprising:

a cap having a normally frontal portion and a posterior portion, a top and a bottom and wherein said posterior portion is provided having a generally inverted U shaped opening extending toward said bottom of said cap;

a first interconnecting strap attached to said cap adjacent to the said opening at the bottom of said cap and extending generally across said opening, said first interconnecting strap having a first engagement region;

an engagement member having an engagement region, said engagement member attached to said cap adjacent the opening at the bottom of said cap and opposite said first interconnecting strap, said first interconnecting strap coupled to said engagement member at the engagement region of said engagement member;

a seamless tubular sheath of compressive, deformable material having a predetermined length extending from a first end to a second end and having an inner sheath surface and an outer sheath surface, said inner sheath surface defining a cavity having dimensions selected to permit said sheath to be disposed over at least a portion of the first engagement region of said first interconnecting strap wherein said sheath is disposed over at least a portion of said first interconnecting strap.

6. The piece of headwear as recited in claim 5 wherein said compressive, deformable material is a closed cell foam.

* * * * *